US011833481B2

(12) United States Patent
Sabey et al.

(10) Patent No.: US 11,833,481 B2
(45) Date of Patent: Dec. 5, 2023

(54) MULTI-CHANNEL, VARIABLE-FLOW MIXERS AND RELATED METHODS

(71) Applicant: Produced Water Absorbents Inc., Houston, TX (US)

(72) Inventors: John Sabey, Houston, TX (US); William Jagers, Houston, TX (US); Yuecun Lou, Houston, TX (US); Vu Phung, Houston, TX (US)

(73) Assignee: PRODUCED WATER ABSORBENTS INC., Houston, TX (US)

( * ) Notice: Subject to any disclaimer, the term of this patent is extended or adjusted under 35 U.S.C. 154(b) by 821 days.

(21) Appl. No.: 16/592,899

(22) Filed: Oct. 4, 2019

(65) Prior Publication Data

US 2020/0108358 A1 Apr. 9, 2020

Related U.S. Application Data

(60) Provisional application No. 62/741,864, filed on Oct. 5, 2018.

(51) Int. Cl.
*B01F 25/00* (2022.01)
*B01F 25/312* (2022.01)
(Continued)

(52) U.S. Cl.
CPC ..... *B01F 25/31232* (2022.01); *B01F 25/311* (2022.01); *B01F 25/3142* (2022.01)

(58) Field of Classification Search
CPC ..... B01F 25/3142; B01F 25/31232; B01F 25/311
See application file for complete search history.

(56) References Cited

U.S. PATENT DOCUMENTS 4,664,147 A 5/1987 Maddock
4,812,049 A 3/1989 McCall
(Continued)

FOREIGN PATENT DOCUMENTS

DE 2508665 9/1976
EP 0300964 1/1989
(Continued)

OTHER PUBLICATIONS

Appeal against decision to refuse European Application No. 05792090.2, filed Feb. 6, 2017.
(Continued)

*Primary Examiner* — Anshu Bhatia
(74) *Attorney, Agent, or Firm* — Norton Rose Fulbright US LLP

(57) ABSTRACT

The present disclosure includes mixing apparatuses comprising a first conduit defining an inlet channel, a second conduit defining an outlet channel, and an injection assembly that is disposed between the first and second conduits. The injection assembly can comprise two or more mixers, each having a reducer conduit that defines a mixing channel and an expander conduit that defines an expanding channel. The injection assembly can also comprise a first injection conduit configured to inject fluid into the mixing channel. At least one of the mixers can comprise a shut-off valve movable from an open position to a closed position in which the shut-off valve prevents fluid from flowing from the mixer to the second conduit. Closing the shut-off valve can increase the fluid flow rate in at least one other of the mixing channels.

19 Claims, 9 Drawing Sheets

(51) Int. Cl.
*B01F 25/31* (2022.01)
*B01F 25/314* (2022.01)

(56) References Cited

U.S. PATENT DOCUMENTS

| | | | | |
|---|---|---|---|---|
| 4,989,988 | A | 2/1991 | Hutter et al. | |
| 5,085,278 | A * | 2/1992 | Keltner | A62C 5/02 169/14 |
| 5,145,256 | A | 9/1992 | Wiemers | |
| 5,547,540 | A | 8/1996 | Ruscheweyh | |
| 5,590,961 | A | 1/1997 | Rasmussen | |
| 5,597,236 | A | 1/1997 | Fasano | |
| 5,839,828 | A | 11/1998 | Glanville | |
| 5,971,604 | A | 10/1999 | Linga et al. | |
| 6,132,079 | A | 10/2000 | King | |
| 6,508,386 | B2 | 1/2003 | Magri | |
| 6,572,258 | B1 | 6/2003 | Holland | |
| 9,295,953 | B2 | 3/2016 | Linga et al. | |
| 2009/0174087 | A1 | 7/2009 | Bauer | |
| 2014/0291258 | A1 * | 10/2014 | Wuerdig | B01F 23/803 210/188 |

FOREIGN PATENT DOCUMENTS

| | | |
|---|---|---|
| GB | 1152194 | 5/1969 |
| WO | WO 2001/007169 | 2/2001 |
| WO | WO 02/00334 | 1/2002 |

OTHER PUBLICATIONS

Decision of the Examining Division of the European Patent Office issued in European Application No. 05792090.2, dated Feb. 15, 2017.
International Preliminary Report on Patentability for PCT/US2014/042365 dated Sep. 29, 2015.
International Search Report and Written Opinion Issued in Corresponding PCT Patent Application No. PCT/US2014/042365, dated Oct. 10, 2014.
International Search Report and Written Opinion issued in PCT/NO2005/000352, dated Jan. 24, 2006.
Office Action issued in European Application No. 05792090.2, dated Jul. 25, 2017.
Response to Attend Oral Proceedings filed in European Application No. 05792090.2, dated Apr. 11, 2014.
Response to Office Action issued in European Application No. 05792090.2, dated Nov. 16, 2017.

* cited by examiner

MULTI-CHANNEL, VARIABLE-FLOW MIXERS AND RELATED METHODS

CROSS-REFERENCE TO RELATED APPLICATIONS

This application claims the benefit of priority to U.S. Provisional Patent Application Ser. No. 62/741,864, filed Oct. 5, 2018, hereby incorporated by reference in its entirety.

FIELD OF INVENTION

The present invention relates generally to fluid mixers and, more particularly but without limitation, to multi-channel, variable-flow pipeline mixers.

BACKGROUND

Fluid mixing finds applications in most industries. For fluids flowing in a pipeline, for example, fluid processing typically involves phase separation of the fluid contents and delivery of the separated contents at a specified quality, according to subsequent use. For example, a stream from a hydrocarbon well is typically separated into oil, gas, and water and the phases are processed and cleaned for contaminants. The processing typically involves injection of fluids such as chemicals, solvents, or extraction fluids. Fluid processing is also common in other industries, such as food production (e.g., production of emulsion), pharmaceuticals, chemicals, paper (e.g., refining and pulp treatment), melts, and other processes. While these processes generally involve batch production in a large vessel, the use of pipe flow mixing is an attractive alternative due to investment, operational costs, flexibility in production, safety, and product quality.

During pipe flow mixing, fluid is typically injected at a low rate compared to the pipe fluid flow rate. Fluid injection can thus pose challenges, including achieving adequate dispersion and mixing of the injected fluid within the pipe fluid. Some systems have attempted to address these challenges with a single, converging pipe section that accelerates pipe fluid and/or a single diverging pipe section downstream of the converging pipe section to facilitate turbulent mixing. However, some of these systems may require controlled injection of fluids, which may limit the injection rate below that required for certain applications. Additionally, these systems may not be able to achieve turbulent mixing if the pipe fluid flow rate decreases below a critical level. Accordingly, there is a need in the art for a mixing apparatus that can efficiently mix injected fluids over a wide range of flow rates.

SUMMARY

The present apparatuses address the need for an efficient pipe mixing apparatus by incorporating multiple mixers into a single assembly. Each of the mixers can comprise a reducer conduit that converges to accelerate pipe fluid and an expander conduit in which the pipe fluid and injected fluid(s) can turbulently mix. Incorporating multiple mixers can advantageously increase the surface area along which the injected fluid(s) can be entrained by the pipe fluid to improve mixing and facilitate adequate injection rates. The present apparatuses can also comprise a first conduit configured to deliver pipe fluid to each of the mixers and a second conduit configured to receive fluid mixtures from each of the mixers without the need for complex piping or manifolds. And, at least one of the mixers can comprise a shut-off valve configured to prevent fluid flow through the mixer and thereby increase the pipe fluid flow rate in at least one other of the mixers. The shut-off valve can thereby facilitate adequate mixing in a subset of the mixers when, for example, the pipe fluid flow rate is insufficient to support turbulent mixing in all of the mixers, or in a single, larger mixer.

Some of the present apparatuses for mixing two or more fluids comprise an injection assembly and, optionally, a first conduit defining an inlet channel and a second conduit defining an outlet channel. The injection assembly, in some apparatuses, is disposed between the first and second conduits and, optionally, the injection assembly, the first conduit, and the second conduit are disposed within a pipe. In some apparatuses, the injection assembly comprises two or more mixers, each having a reducer conduit and, optionally, an expander conduit. The reducer conduit, in some apparatuses, defines a mixing channel between a reducer inlet and a reducer outlet. In some apparatuses, the reducer inlet is coupled to the first conduit and, optionally, the reducer conduit converges that that a cross-sectional area of the mixing channel decreases from the reducer inlet to the reducer outlet. The expander conduit, in some apparatuses, defines an expanding channel between an expander inlet and an expander outlet. In some apparatuses, the expander inlet is coupled to the reducer outlet and, optionally, the expander outlet is coupled to the second conduit. In some apparatuses, the expander conduit diverges such that a cross-sectional area of the expanding channel increases from the expander inlet to the expander outlet.

The first conduit, in some apparatuses, has a first inlet and a first outlet, optionally two or more first outlets. In some apparatuses, each of the first outlets is coupled to a respective one of the reducer inlets. The first conduit, in some apparatuses, converges such that a cross-sectional area of the inlet channel decreases from the first inlet to the first outlets. In some apparatuses, a cross-sectional area of the inlet channel at each of the first outlets is within 10% of the cross-sectional area of the mixing channel at the reducer inlet.

The second conduit, in some apparatuses, has a second inlet, optionally two or more second inlets, and a second outlet. In some apparatuses, each of the second inlets is coupled to a respective one of the expander outlets. Optionally, the expander conduit diverges such that a cross-sectional area of the outlet channel increases from the second inlets to the second outlet. In some apparatuses, the outlet channel has a cross-sectional area at each of the second inlets that is within 10% of the cross-sectional area of the expanding channel at the expander outlet.

Each of the mixers, in some apparatuses, comprises a first injection conduit configured to receive fluid and inject the fluid into the mixing channel, optionally at a first location. In some apparatuses, each of the mixers comprises a second injection conduit configured to receive fluid and inject the fluid into the mixing channel at a second location that is closer to the reducer outlet than is the first location. For each of the mixers, in some apparatuses, the first injection conduit comprises a first annular cavity that is defined around the reducer conduit and, optionally, is in fluid communication with the mixing channel via a plurality of first passages defined through the reducer conduit. Some of such apparatuses comprise, for each of the mixers, a first draining conduit configured to permit fluid communication between the first annular cavity and a draining nozzle. In some apparatuses, for each of the mixers, the second injection conduit comprises a second annular cavity that is defined around the reducer conduit and, optionally, is in fluid communication with the mixing channel via a plurality of second passages defined through the reducer conduit. In some of such apparatuses, the first passages collectively define a first injection area and the second passages collectively define a second injection area that is smaller than the first injection area.

In some apparatuses, for each of the mixers, the cross-sectional area of the mixing channel at the reducer outlet is at least 10% smaller than the cross-sectional area of the expanding channel at the expander inlet. In some apparatuses, at least one of the mixers comprises a shut-off valve that is movable between an open position and a closed position in which the shut-off valve prevents fluid from flowing from the mixer to the second conduit.

Some of the present methods for mixing two or more fluids comprise communicating a first fluid through an inlet channel defined by a first conduit and, optionally, into two or more mixing channels, each defined by a reducer conduit. In some methods, the communicating comprises accelerating the first fluid through the inlet channel. Some methods comprise accelerating the first fluid in each of the mixing channels and, optionally, injecting a second fluid into each of the mixing channels, optionally at a first location. In some methods, the injecting is performed such that the first and second fluids flow into an expanding channel defined by an expander conduit. In some methods, the injecting is performed such that the second fluid flows along an inner surface of the reducer conduit. In some methods, the first and second fluids mix, optionally in the expanding channel, to form a fluid mixture. Some methods comprise, for each of the mixing channels, injecting a third fluid at a second location that is closer to the expander conduit than is the first location. In some of such methods, the injecting is performed such that the first, second, and third fluids mix in the expanding channel and, optionally, the fluid mixture comprises the third fluid. Some methods comprise, for each of the expanding channels, decelerating the fluid mixture and, optionally, combining the fluid mixtures in an outlet channel defined by the second conduit. Combining the fluid mixtures, in some methods, comprises decelerating the fluid mixtures in the outlet channel. In some methods, the inlet channel, the mixing channels, the expanding channels, and the outlet channel are disposed within a pipe.

In some methods, each of the reducer conduits comprises a reducer inlet coupled to the first conduit and a reducer outlet coupled to the expander conduit and, optionally, converges from the reducer inlet to the reducer outlet such that the first fluid accelerates when communicated through the mixing channel. In some methods, each of the expander conduits comprises an expander inlet coupled to the reducer conduit and an expander outlet coupled to the second conduit; and, optionally, diverges from the expander inlet to the expander outlet such that the fluid mixture decelerates when communicated through the expanding channel.

In some methods, for each of the mixing channels, injecting the second fluid comprises communicating the second fluid to a first annular cavity disposed around the reducer conduit, and, optionally, transferring the second fluid from the first annular cavity to the mixing channel via a plurality of first passages. In some methods, for each of the mixing channels, injecting the third fluid comprises communicating the third fluid to a second annular cavity disposed around the reducer conduit, and, optionally, transferring the third fluid from the second annular cavity to the mixing channel via a plurality of second passages. In some of such methods, the first passages collectively define a first injection area and the second passages collectively define a second injection area that is smaller than the first injection area.

Some methods comprise, for at least one of the mixing channels, moving a shut-off valve from an open position to a closed position such that fluid does not flow from the mixing channel to the outlet channel and, optionally, a flow rate of the first fluid in at least one other of the mixing channels increases.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified—and includes what is specified; e.g., substantially 90 degrees includes 90 degrees and substantially parallel includes parallel—as understood by a person of ordinary skill in the art. In any disclosed embodiment, the term "substantially" may be substituted with "within [a percentage] of" what is specified, where the percentage includes 0.1, 1, 5, and 10 percent.

The terms "comprise" and any form thereof such as "comprises" and "comprising," "have" and any form thereof such as "has" and "having," and "include" and any form thereof such as "includes" and "including" are open-ended linking verbs. As a result, an apparatus that "comprises," "has," or "includes" one or more elements possesses those one or more elements, but is not limited to possessing only those elements. Likewise, a method that "comprises," "has," or "includes" one or more steps possesses those one or more steps, but is not limited to possessing only those one or more steps.

Any embodiment of any of the apparatuses, systems, and methods can consist of or consist essentially of—rather than comprise/include/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

Further, a device or system that is configured in a certain way is configured in at least that way, but it can also be configured in other ways than those specifically described.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. Views in the figures are drawn to scale, unless otherwise noted, meaning the sizes of the depicted elements are accurate relative to each other for at least the embodiment in the view.

FIG. 1D illustrates the multi-channel design of the mixing apparatus.

FIG. 3A illustrates the structure of the first injection conduits in accordance with some embodiments of the present invention.

FIG. 4A illustrates the structure of the second injection conduits in accordance with some embodiments of the present invention.

FIGS. 5A and 5B illustrate a shut-off valve movable between an open position (FIG. 5A) and a closed position (FIG. 5B) in which the shut-off valve prevents fluid from flowing through one of the mixers.

DETAILED DESCRIPTION OF ILLUSTRATIVE EMBODIMENTS

Figure 1A:
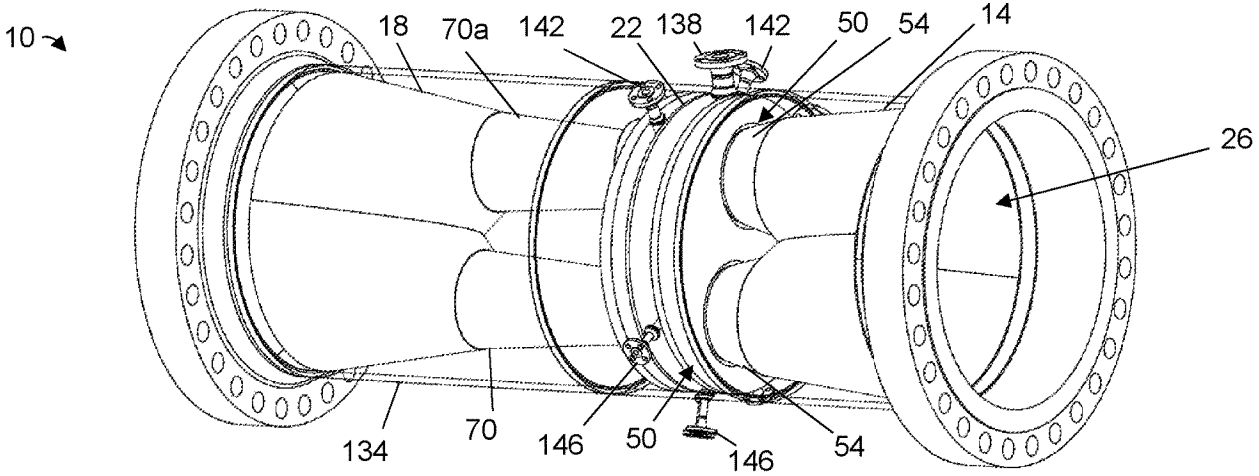
FIG. 1A is a perspective view of an embodiment of the present mixing apparatuses, where the pipe containing the first conduit, the second conduit, and the injection assembly is represented transparently to illustrate the features disposed therein.
Figure 1B:
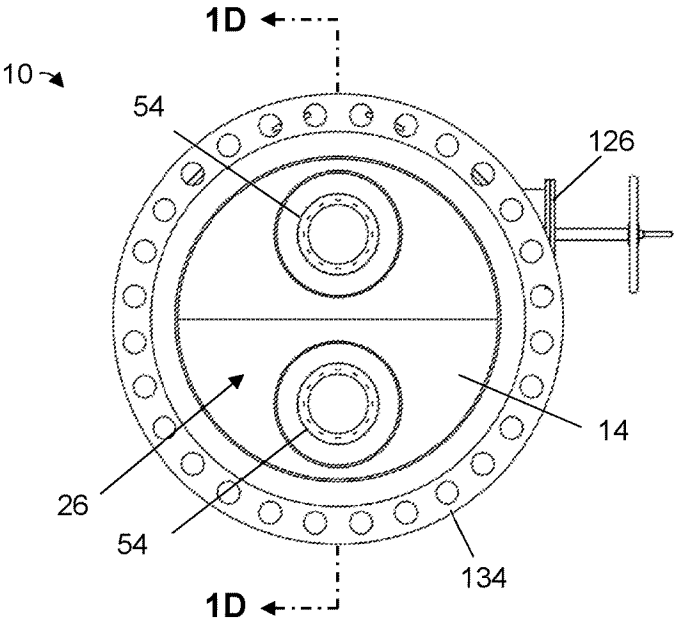
FIGS. 1B and 1C are front and rear views, respectively, of the mixing apparatus of FIG. 1A.
Figure 1C:
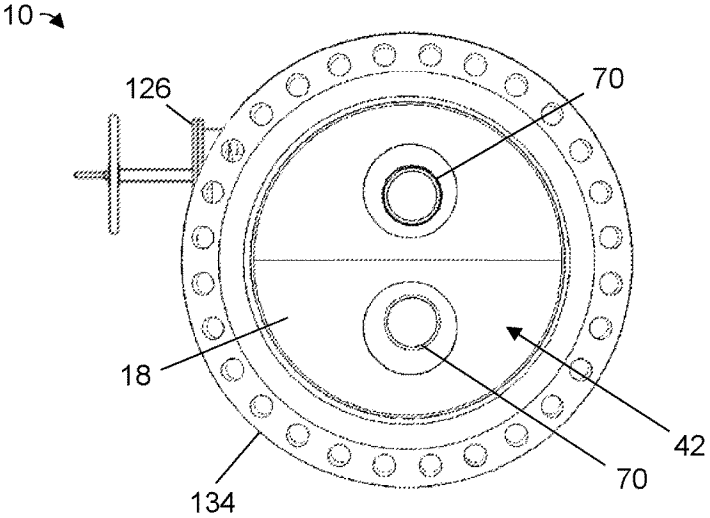
Figure 1D:
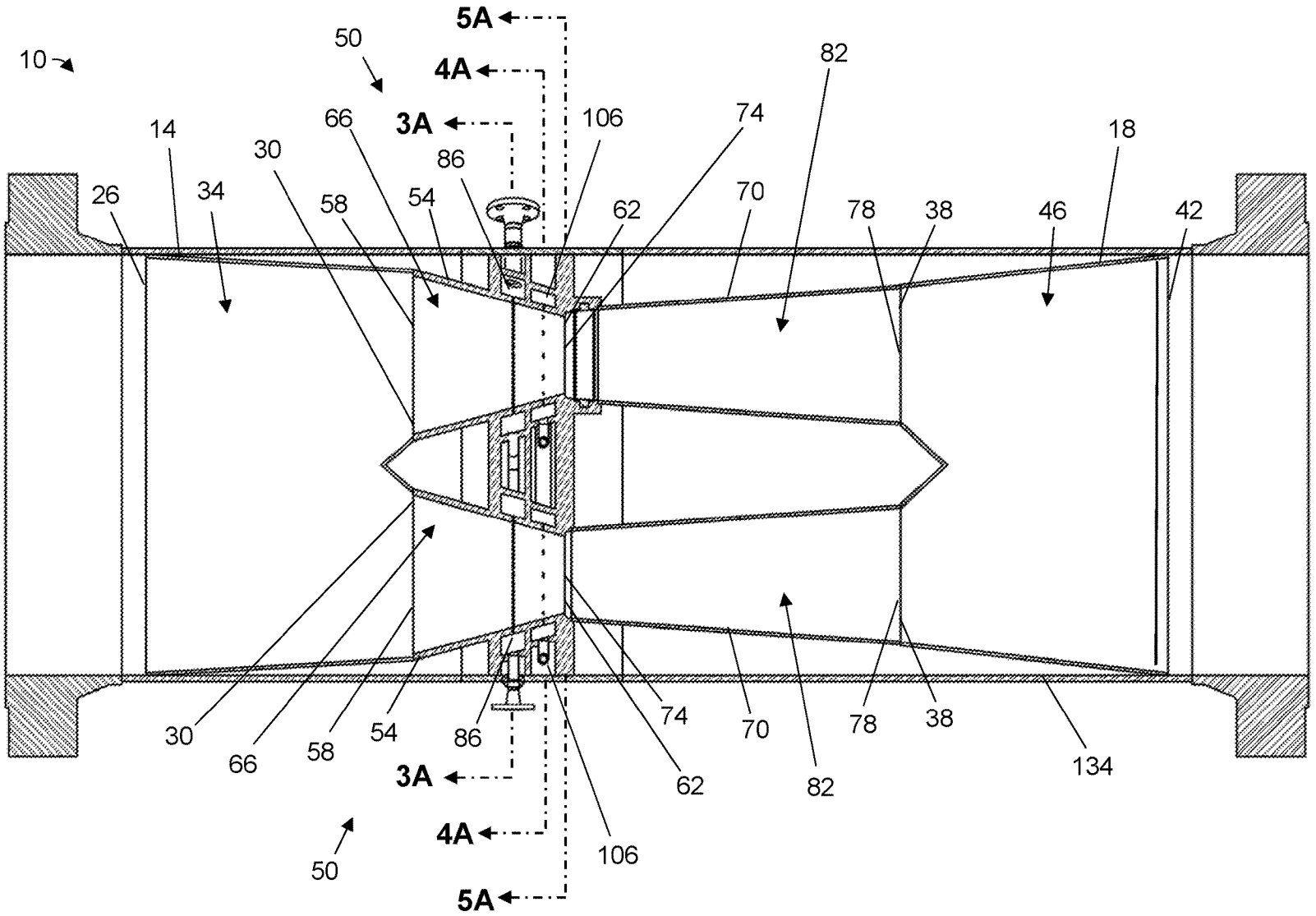
FIG. 1D is a sectional view of the mixing apparatus of FIG. 1A taken along line 1D-1D in FIG. 1B.

Referring to FIGS. 1A-1D, shown is an embodiment 10 of the present mixing apparatuses. Mixing apparatus 10 can comprise a first conduit 14 defining an inlet channel 34, a second conduit 18 defining an outlet channel 46, and an injection assembly 22 disposed between the first and second conduits. Injection assembly 22 can comprise two or more mixers 50, each comprising a reducer conduit 54 defining a mixing channel 66 and an expander conduit 70 defining an expanding channel 82. Fluid communicated through first conduit 14 can flow through mixers 50, where the fluid can be mixed with injected fluids, and thereafter exit mixing apparatus 10 via second conduit 18.

Mixing apparatus 10 can facilitate the use of multiple mixers 50 without the need for complex piping or manifolds. As shown, first conduit 14 can have a first inlet 26 configured to receive fluid (e.g., from a pipe coupled to mixing apparatus 10) and two or more first outlets 30, one for each of mixers 50. Fluid flowing through inlet channel 34 can exit first conduit 14 via one of first outlets 30 to enter one of mixers 50. For example, each of reducer conduits 54 can have a reducer inlet 58 coupled to a respective one of first outlets 30 such that mixing channel 66 is configured to receive fluid from inlet channel 34 via the reducer inlet.

The fluid mixtures formed in each of mixers 50—described in further detail below—can be combined (e.g., into a single pipe flow) in outlet channel 46 of second conduit 18. Second conduit 18 can have, for example, two or more second inlets 38. Expander outlet 78 of each of mixers 50 can be coupled to a respective one of second inlets 38 such that the fluid mixture can flow from expanding channel 82 into outlet channel 46 via the expander outlet and the second inlet. The combined fluid mixtures can flow through outlet channel 46 and exit mixing apparatus 10 (e.g., via second outlet 42 of second conduit 18) (e.g., to a pipe coupled to the mixing apparatus).

Advantageously, each of first conduit 14, second conduit 18, injection assembly 22, and the respective components thereof, can be disposed within a pipe 134. Pipe 134 can be readily coupled to another fluid-carrying pipe (e.g., to a pipeline). Multiple mixers 50 can thus be used (e.g., to inject multiple types of fluids and/or to promote efficient mixing, described in further detail below) without the need for separate, complex piping or manifolds that would otherwise be required to couple different mixers to the fluid-carrying pipe. Mixing apparatus 10, at least in part due to its simplicity, can thereby provide cost-effective and reliable mixing with multiple mixers 50.

Figure 2:
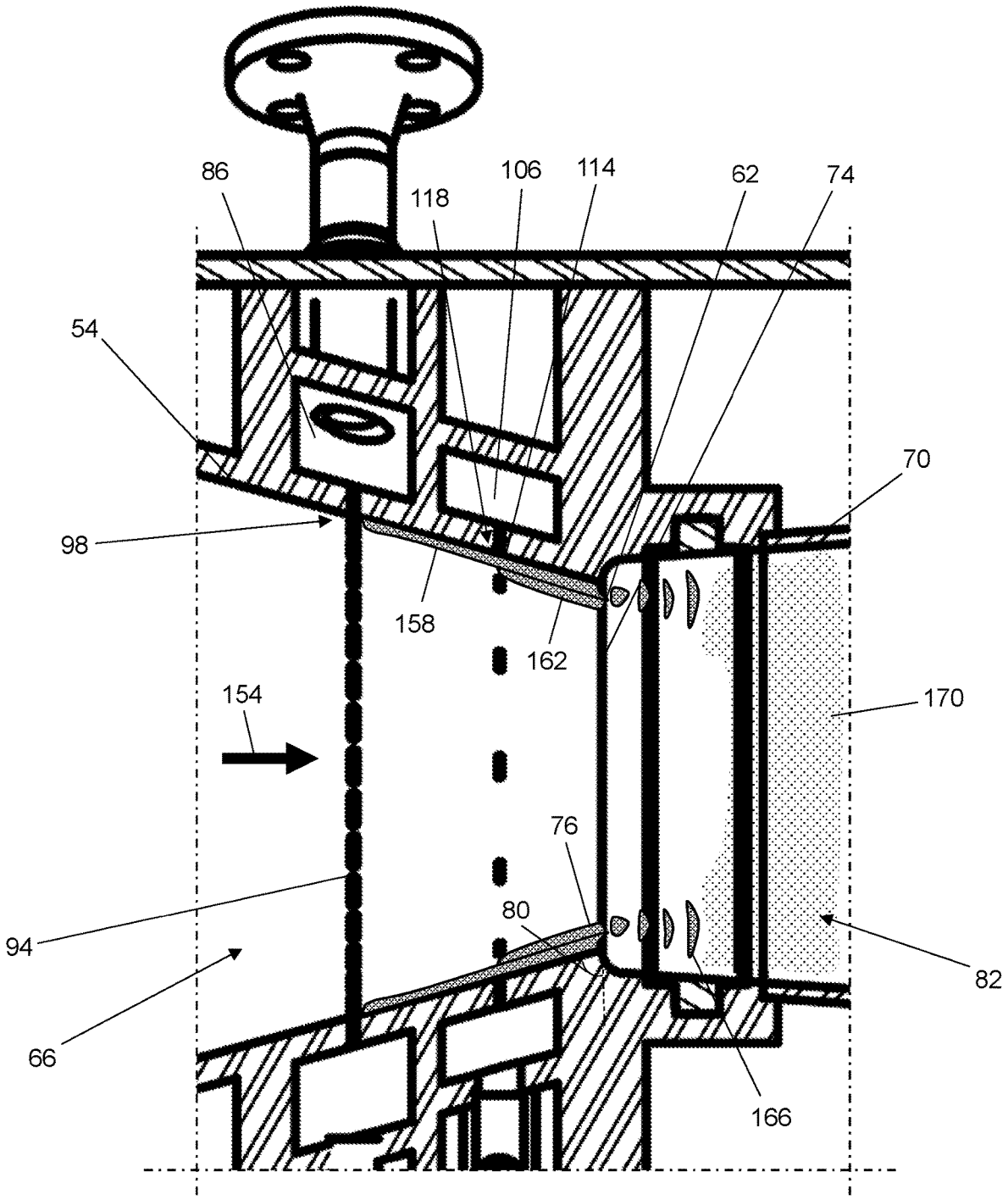
FIG. 2 is an enlarged, partial sectional view of one of the mixers illustrated in FIG. 1D, schematically illustrating turbulent mixing of first, second, and third fluids in accordance with some embodiments of the present invention.

Referring additionally to FIG. 2, which shows a partial close-up view of one of mixers 50, each of the mixers is configured to efficiently mix a first fluid (e.g., 154) flowing therein with one or more injected fluids (e.g., 158 and/or 162). Mixers 50 are described below with reference to a single one of the mixers; however, other one(s) of the mixers can be substantially the same as (e.g., identical to) and/or can have one or more of the features of the mixer described herein. Mixer 50 can comprise a first injection conduit 86 configured to receive a second fluid (e.g., 158) and inject the received second fluid into mixing channel 66 at a first location 98. Optionally, mixer 50 can comprise a second injection conduit 106 that is configured to receive a third fluid (e.g., 162) and inject the received third fluid into mixing channel 66 at a second location 118 that is downstream of first location 98 (e.g., the second location is closer to reducer outlet 62 than is the first location).

Mixer 50 can turbulently mix the first fluid and the injected fluid(s) (e.g., 154 and/or 158) to promote efficient mixing. For example, first injection conduit 86 and/or second injection conduit 106 can be configured to inject fluid into mixing channel 66 such that the injected fluid flows along the inner surface of reducer conduit 54, rather than within the first fluid flow in the mixing channel. After passing sharp edge 76 (e.g., at reducer outlet 62), the injected fluid can break off from the inner surface of reducer conduit 54 and form filaments (e.g., 166) that enter expanding channel 82. The filaments can break up into droplets which, due at least in part to their relatively large surface area to volume ratio, can intimately mix with the first fluid to form a fluid mixture (e.g., 170) comprising the first fluid, the second fluid, and/or the third fluid.

The geometry of mixer 50 can facilitate this efficient, turbulent mixing. Reducer conduit 54 can converge from its reducer inlet 58 to its reducer outlet 62 such that the cross-sectional area of mixing channel 66 decreases from the reducer inlet to the reducer outlet. The decreasing cross-sectional area can cause the first fluid flowing through mixing channel 66 to accelerate as the first fluid approaches reducer outlet 62 and sharp edge 76. The increased fluid velocity can facilitate the generation and break-up of filaments of the injected fluid(s). To illustrate, filament generation is a function of the relative velocity (U) between the first fluid and the injected fluid(s), in addition to the geometry of sharp edge 76 and the surface tension between the different fluids. The accelerated first fluid can, for example, entrain the injected fluid(s) along the inner surface of reducer conduit 54 and over sharp edge 76 to promote filament generation.

The increased first fluid velocity in mixing channel 66 can also promote the breaking up of filaments into high surface area droplets. Principles governing turbulent mixing to promote filament generation and break up are described in U.S. Pat. No. 9,295,953, which is hereby incorporated by reference in its entirety. Filament break-up is governed at least in part by the Weber number (We) of the fluid:

$$We = \frac{\rho U^2 d}{\sigma}$$

where ρ is the density of the first fluid flowing through the mixing channel, U is the relative velocity between the first fluid and the injected fluid(s), d is the characteristic filament dimension, and σ is the surface tension between the first fluid and the injected fluid(s). Filament break-up occurs when We exceeds the critical Weber number ($We_{cr}$). At least for wind tunnel experiments and droplet injection into the flow field, $We_{cr}$ can be, for example, between 8 and 10. Because We is proportional to the square of the relative velocity between the first fluid and the injected fluid(s), the acceleration of the first fluid—and thus the convergence of reducer conduit 54—can significantly increase the break-up of the filaments to improve mixing efficiency.

The increased first fluid velocity resulting from converging reducer conduit 54 can also facilitate efficient mixing by promoting droplet dispersion across the cross-section of expanding channel 82. Droplet dispersion is at least in part a function of the Reynolds number (Re) of the fluid mixture (e.g., 170):

$$\mathrm{Re} = \frac{\rho_m U_m D}{\mu_m}$$

where D is the local conduit diameter, $U_m$ is the local mixture velocity, and $\rho_m$ and $\mu_m$ are the density and viscosity of the fluid mixture, respectively. The first fluid's increased velocity can increase the Reynolds number of the fluid mixture and thus improve radial droplet dispersion across the cross-section of expanding channel 82. Such dispersion promotes efficient mixing, at least by preventing a concentration of the injected fluid(s) in the center of expanding channel 82.

First conduit 14 can similarly facilitate filament generation and break-up by accelerating the first fluid before the first fluid enters mixing channel 66. For example, first conduit 14 can converge from first inlet 26 to first outlets 30 such that the cross-sectional area of inlet channel 34 decreases from the first inlet (e.g., where the cross-sectional area can be substantially the same as that of pipe 134) to the first outlet to accelerate fluid flowing therein. First conduit 14 can thereby promote turbulent mixing for the above-described reasons. And, not to be bound by any particular theory, the cross-sectional area of inlet channel 34 at first outlet 30 can be substantially the same as (e.g., within 10% of) the cross-sectional area of mixing channel 66 at reducer inlet 58 to minimize pressure losses as fluid flows from the inlet channel to the mixing channel.

The boundary between reducer conduit 54 and expander conduit 70 can also facilitate filament generation and break-up. Expander conduit 70 can have an expander inlet 74 coupled to reducer outlet 62, via which fluids enter expanding channel 82 from mixing channel 66. The cross-sectional area of mixing channel 66 at reducer outlet 62 can be smaller than (e.g., at least 10%, 20%, 30%, 40%, 50%, 60%, or 70% smaller than) the cross-sectional area of expanding channel 82 at expander inlet 74 such that a sharp edge 76 is defined at the reducer outlet (e.g., at the end of reducer conduit 54). As a result, a stagnant volume can be formed downstream of sharp edge 76, which can facilitate turbulence generation and thus efficient mixing. Sharp edge 76 can be configured to have an angle 80 (e.g., the angle defined between the surface of reducer conduit 54 at reducer outlet 62 and the abutting surface of expander conduit 70 at expander inlet 74) that is appropriate for facilitating the distribution of injected fluid(s) into the first fluid. For example, angle 80 can be acute (e.g., less than 90°) to provide a relatively sharper edge that may improve the breaking off of viscous liquids—which may have a higher affinity for the inner surface of reducer conduit 54—to generate filaments. Angle 80 may be 90° or obtuse for less viscous fluids, which may not require an acute angle for filament generation.

Expander conduit 70 can diverge from its expander inlet 74 to its expander outlet 78 such that the cross-sectional area of expanding channel 82 increases from the expander inlet to the expander outlet. The fluid mixture can accordingly decelerate as it flows through expander conduit 70. Such deceleration can increase the pressure of the fluid mixture to at least partially offset the fluid pressure loss that can occur in reducer conduit 54 when the first fluid accelerates. Expander conduit 70 can thereby reduce the permanent pressure drop across fluid mixer 50.

Second conduit 18 can similarly mitigate pressure losses when combining the fluid mixtures generated by mixers 50. Second conduit 18 can diverge from second inlets 38 to second outlet 42 such that the cross-sectional area of outlet channel 46 increases from the second inlets to the second outlet. The expansion of second conduit 18 can, similar to expanding conduits 70, decelerate the fluid mixtures (e.g., to a velocity substantially the same as the fluid velocity entering mixing apparatus 10) to reduce the permanent pressure drop across the mixing apparatus. And, not to be bound by any particular theory, the cross-sectional area of outlet channel 46 at each of second inlets 38 can be substantially the same as (e.g., within 10% of) the cross-sectional area of expanding channel 82 at expander outlet 78 to further minimize pressure losses.

Figure 3A:
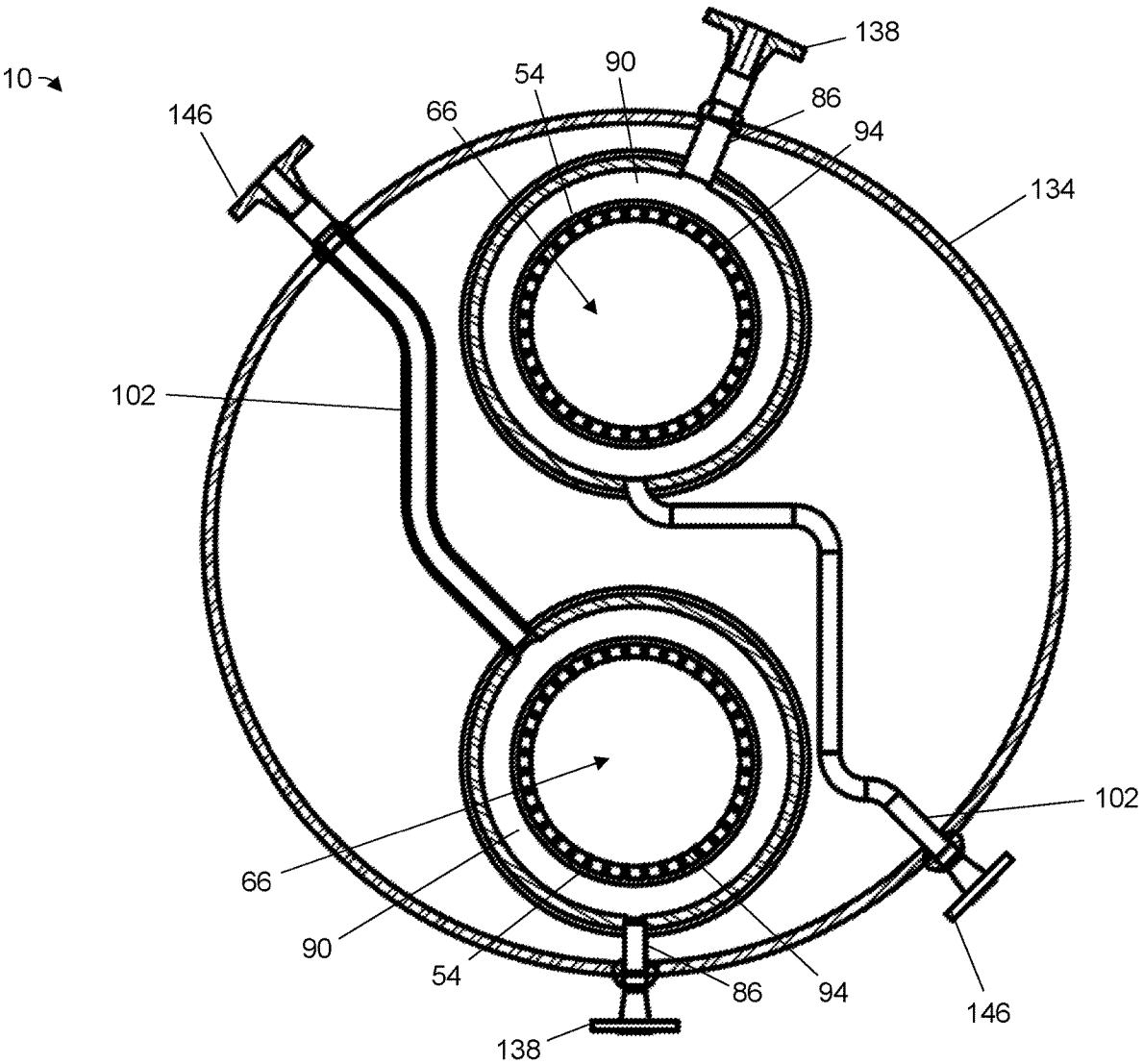
FIG. 3A is a sectional view of the mixing apparatus of FIG. 1A taken along line 3A-3A in FIG. 1D.
Figure 3B:
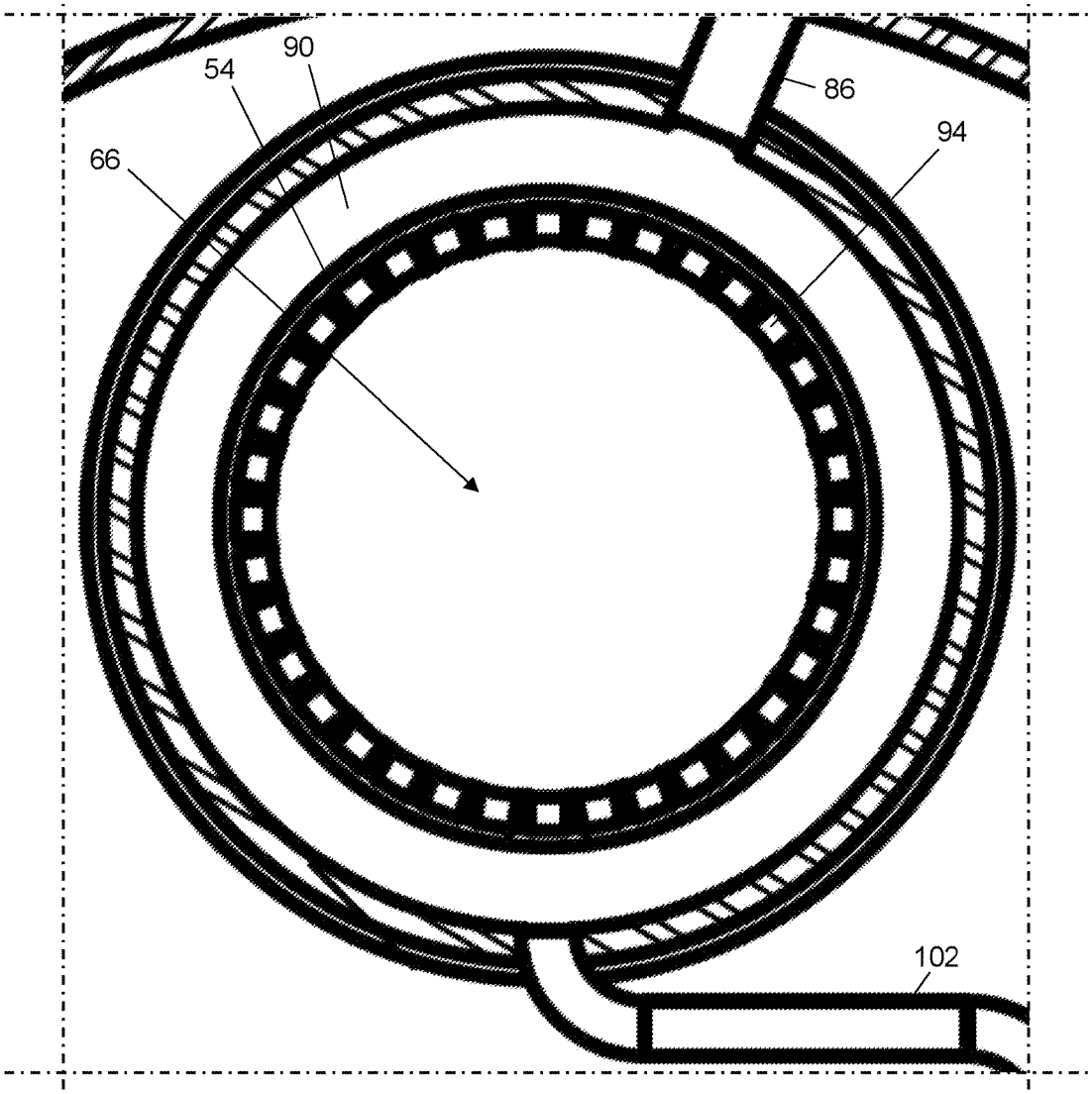
FIG. 3B is an enlarged sectional view illustrating one of the first injection conduits of FIG. 3A.

Referring additionally to FIGS. 3A and 3B, first fluid conduit 86 can also be configured to facilitate efficient mixing in mixer 50. First fluid conduit 86 can comprise a first annular cavity 90 defined around reducer conduit 54 and configured to receive the second fluid via one of first injection nozzles 138 coupled to pipe 134. A plurality of first passages 94 can be defined through reducer conduit 54 (e.g., around the circumference of the reducer conduit) to permit fluid communication between first fluid conduit 86 and mixing channel 66. Each of first passages 94 can be relatively narrow (e.g., can have a width less than or equal to 1 mm, 0.8 mm, 0.6 mm, 0.4 mm, 0.2 mm, or less (e.g., less than or equal to 0.2 mm)) to provide a controlled injection of the second fluid onto the inner surface of reducer conduit 54. First annular cavity 90 and first passages 94 can thereby improve entrainment of the second fluid along the inner surface of reducer conduit 54 for filament formation—as described above-compared to conventional nozzles, which may undesirably inject fluid into the mixing channel flow stream. First passages 94 can also promote uniform distribution of the second fluid about the interior surface of reducer conduit 54 to facilitate droplet dispersion during mixing Injection assembly 22 can further comprise, for each of mixers 50, a first draining conduit 102 configured to drain fluid from first annular cavity 90 to one of first draining nozzles 146 coupled to pipe 134. Not to be bound by any particular theory, first draining conduit 102 can provide further injection control, e.g., by permitting control of the fluid pressure within first cavity 90.

Figure 4A:
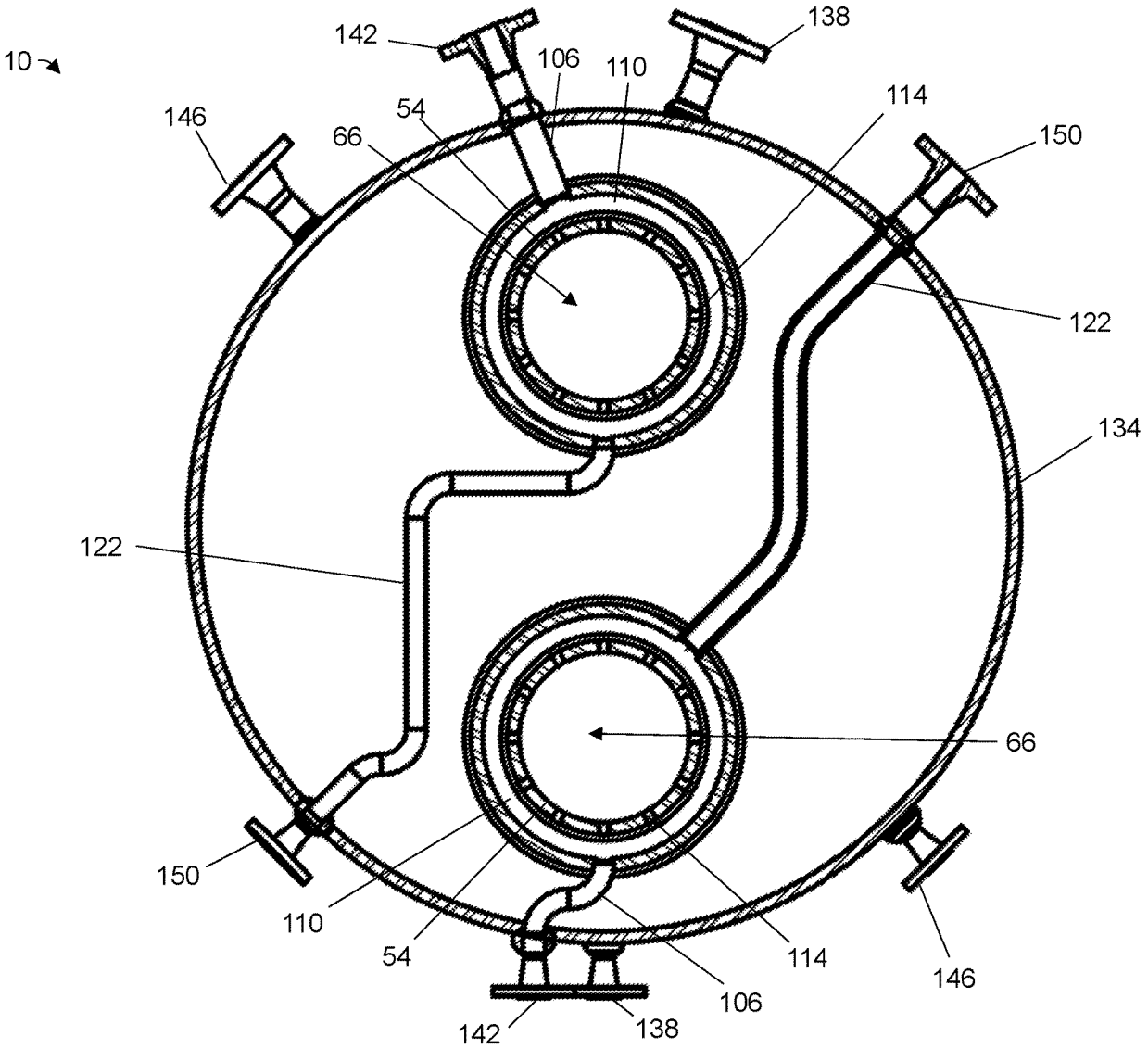
FIG. 4A is a sectional view of the mixing apparatus of FIG. 1A taken along line 4A-4A in FIG. 1D.
Figure 4B:
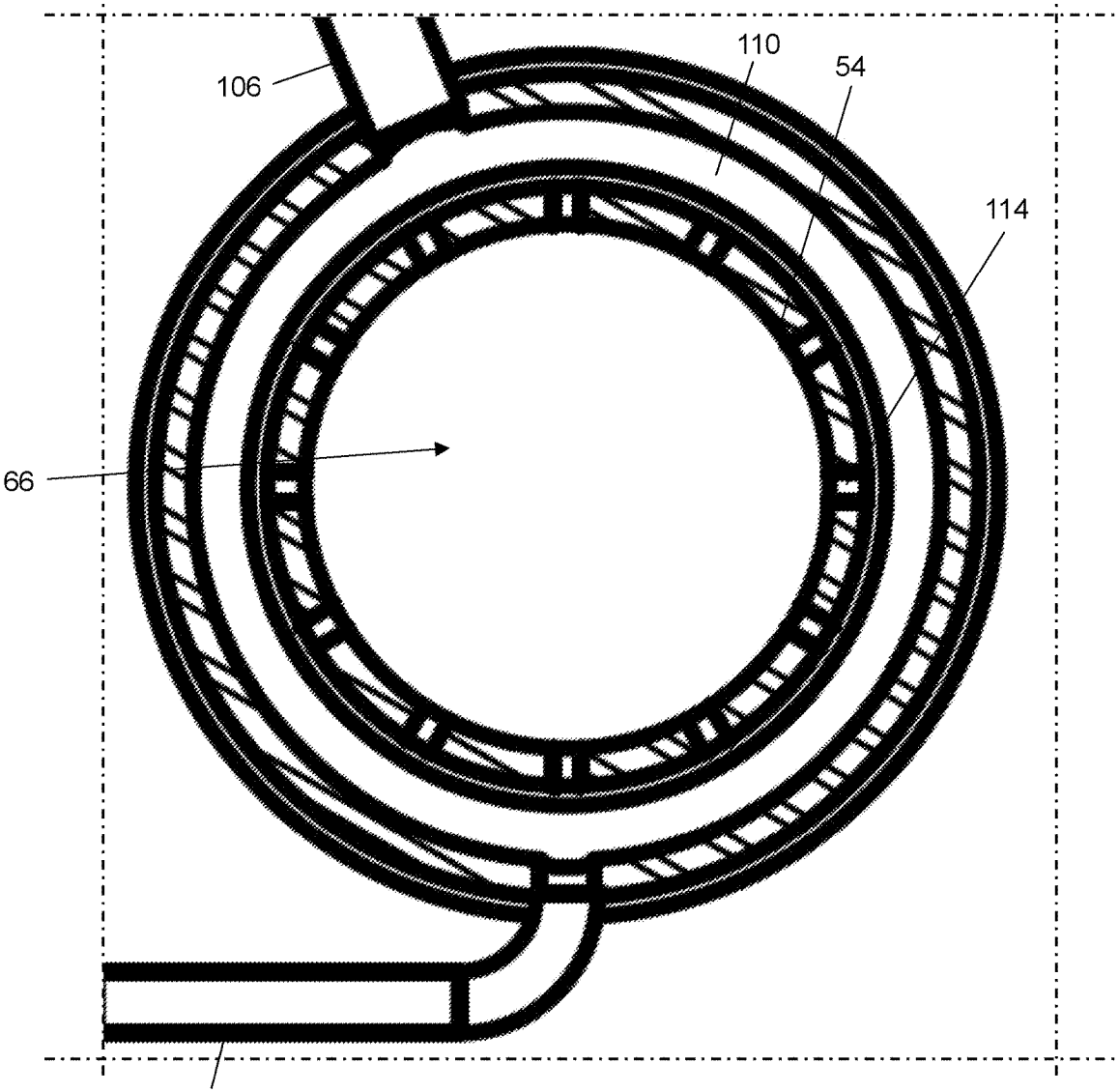
FIG. 4B is an enlarged sectional view illustrating one of the second injection conduits of FIG. 4A.

Referring additionally to FIGS. 4A and 4B, second fluid conduit 106—if present—can be configured similarly to first conduit 86. Second fluid conduit 106 can comprise a second annular cavity 110 defined around reducer conduit 54 and configured to receive the third fluid via one of second injection nozzles 142. A plurality of second passages 114 can be defined through reducer conduit 54 (e.g., around the circumference of the reducer conduit) to permit fluid communication between second fluid conduit 106 and mixing channel 66. Each of second passages 114 can be sized to, as with first passages 94, provide a controlled injection of the third fluid onto the inner surface of reducer conduit 54 and thereby promote proper entrainment and dispersion of the third fluid along the inner surface of the reducer conduit. And, injection assembly 22 can comprise, for each of mixers 50, a second draining conduit 122 that, similar to first draining conduit 102, is configured to drain fluid from second annular cavity 110 to one of second draining nozzles 150 coupled to pipe 134 to improve injection control.

Optionally, first passages 94 can collectively define a first injection area and second passages 114 can collectively define a second injection area that is smaller than the first injection area. As shown, for example, there are more first passages 94 than second passages 114, e.g., to permit a higher flow rate from first fluid conduit 86 than from second fluid conduit 106. Not to be bound by any particular theory, incorporating multiple fluid conduits in this manner can facilitate injection of an adequate fluid volume while maintaining entrainment along the inner surface of reducer conduit 54. For example, the controlled injection of fluids from first fluid conduit 86 may not permit an adequate fluid volume to be injected into mixing channel 66. Second fluid conduit 106 can provide a controlled injection of additional fluid to meet the volume requirements, and providing a lower flow rate through second passages 114 may, for example, mitigate the additional injected fluid's tendency to disturb and detach the entrained second fluid from the inner surface of reducer conduit 54.

Figure 5A:
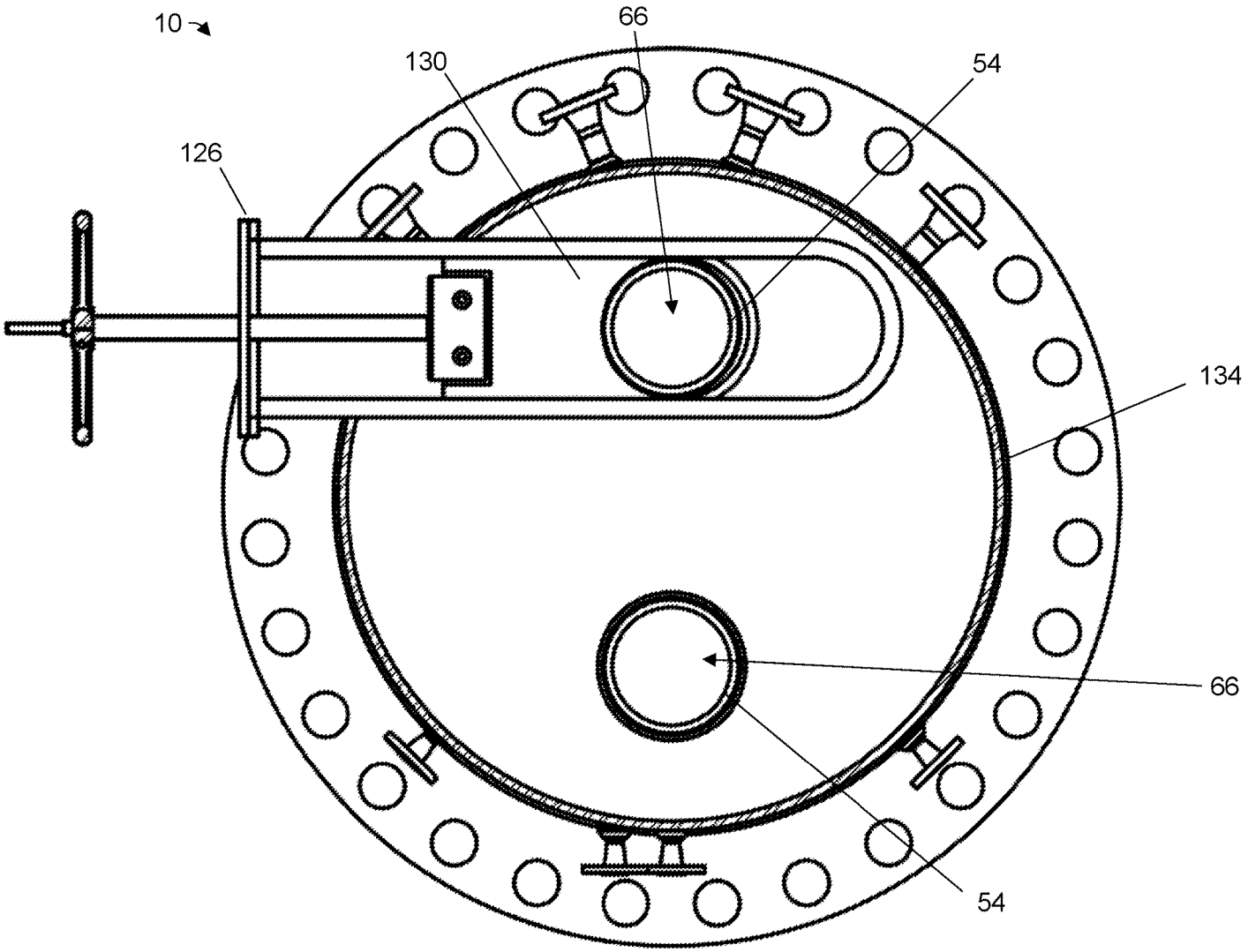
FIGS. 5A and 5B are sectional views of the mixing apparatus of FIG. 1A taken along line 5A-5A in FIG. 1D.
Figure 5B:
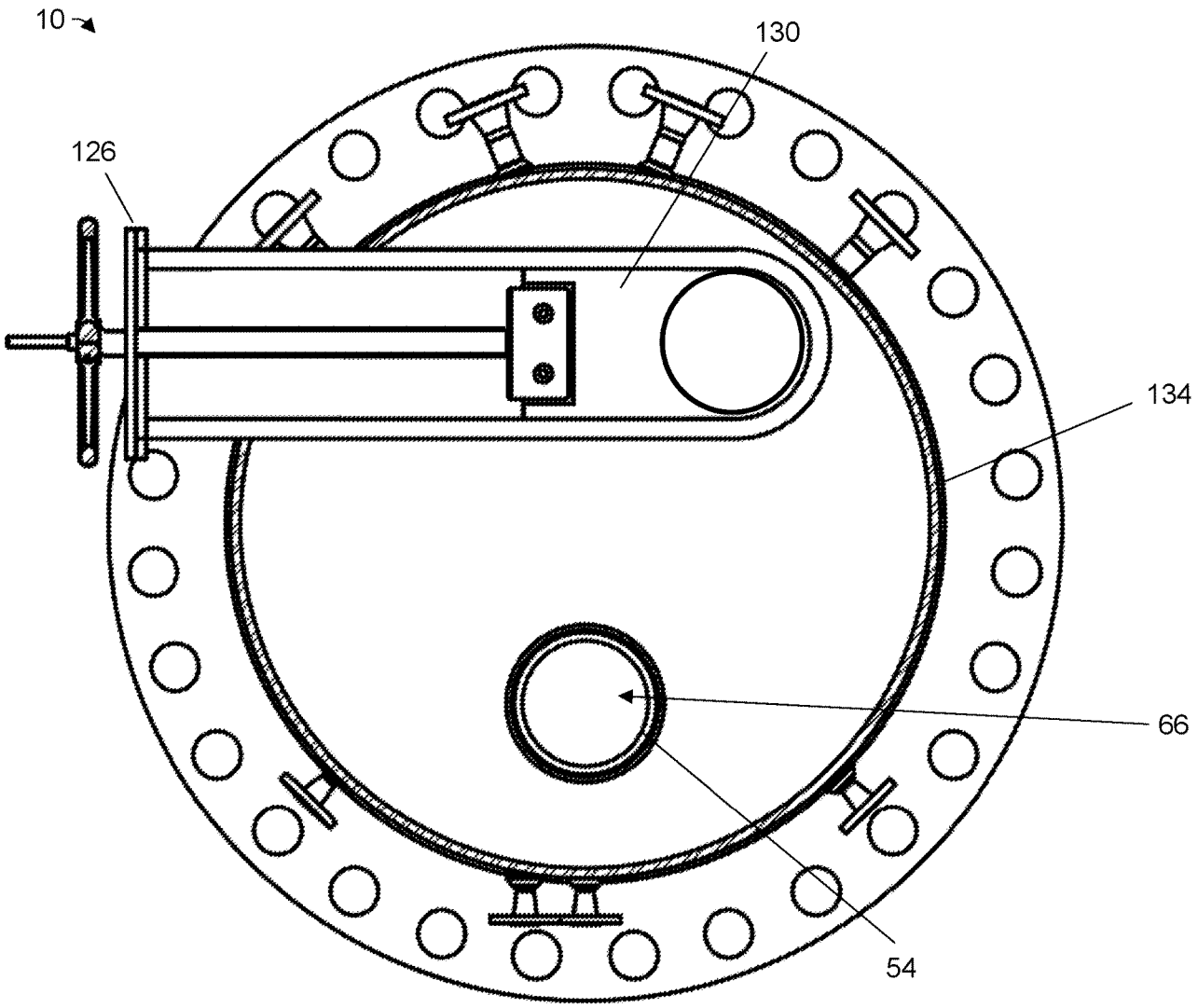

The use of multiple mixers 50 can facilitate efficient mixing. For example, multiple reducer conduits 54 can provide an increased surface area for entrainment of the injected fluid(s), compared to a single-mixer apparatus, to improve filament generation and droplet dispersion. Similarly, and not to be bound by any particular theory, using multiple mixers 50 can provide an increased injection area (e.g., due to the presence of multiple first and/or second injection conduits 86 and 106) to permit higher—yet still controlled—fluid injection rates compared to a single-mixer apparatus. And, referring to FIGS. 5A and 5B, mixing apparatus 10 can be configured to adjust the flow through mixers 50 in response to changes in fluid flow rate to ensure proper mixing. As shown, at least one of mixers 50 can comprise a shut-off valve 126 movable between an open position (FIG. 5A) in which fluid can flow through the mixer, as described above, and a closed position (FIG. 5B) in which fluid cannot flow from the mixer to second conduit 18. For example, and without limitation, shut-off valve 126 can comprise a gate 130 that can be actuated (e.g., mechanically, hydraulically, and/or electrically) to obstruct mixing channel 66 and/or expanding channel 82 to prevent fluid from flowing therethrough. Shut-off valve 126 or may not have seals to facilitate flow prevention, and, while shown as having a gate 130, can comprise any suitable valve.

When shut-off valve 126 is in the closed position, fluid flow rate—and thus velocity can increase through the other one(s) of mixers 50 that remain in fluid communication with second inlet 18. Shut-off valve 126 can thereby improve mixing efficiency when, for example, the fluid flow rate into mixing apparatus 10 decreases such that the fluid, if permitted to flow through all of mixers 50, would have insufficient velocity for filament formation and/or break-up (e.g., such that the We would be below $We_{cr}$). Diverting flow to a subset of mixers 50 by closing shut-off valve(s) 126 can ensure that the subset of mixers receive adequate flow to facilitate the above-described turbulent mixing.

Mixing apparatus 10 can be used to mix any suitable combination of fluids. For example, mixing apparatus 10 can be configured to inject and mix one or more gases and/or one or more liquids into a gas and/or into a liquid communicated from first inlet 14. To illustrate, and without limitation, mixing apparatus 10 can be configured to receive and mix one or more hydrocarbons (e.g., oil and/or gas) (e.g., natural gas) and/or water with the injected fluid(s). The injected fluid(s) (e.g., second fluid 158 and/or third fluid 162) can comprise one or more chemicals, solvents, additives, or extraction fluids. To illustrate, and without limitation, the injected fluid(s) can comprise a scavenger or irreversible solvent (e.g., to remove sour constituents such as $H_2S$), a corrosion inhibitor, a hydrate inhibitor, a scale inhibitor, a wax inhibitor, a drag reducer, a desalter, a de-emulsifier, a deoiler, a defoamer, an antifoulant, a flocculant, a condensate or hydrocarbon, a gas, and/or water.

The present methods for mixing two or more fluids can include using any of the present mixing apparatuses (e.g., 10), e.g., in any of the ways described above. Some methods, for example, comprise a step of communicating a first fluid (e.g., 154) through an inlet channel (e.g., 34) defined by a first conduit (e.g., 14) and into two or more mixing channels (e.g., 66), each defined by a reducer conduit (e.g., 54). The first fluid can be, for example, natural gas. In some methods, communicating can include accelerating the first fluid through the inlet channel (e.g., if a cross-sectional area of the inlet channel decreases in a downstream direction, as described above).

Some methods comprise a step of accelerating the first fluid in each of the mixing channels. The reducer conduit can have a reducer inlet (e.g., 58) and a reducer outlet (e.g., 62), and can converge such that the cross-sectional area of the mixing channel decreases from the reducer inlet and the reducer outlet (e.g., as described above). Accelerating thus can comprise transferring the first fluid from the inlet channel to the mixing channel via the reducer inlet and communicating the first fluid through the mixing channel such that the first fluid accelerates.

Some methods comprise a step of injecting a second fluid (e.g., 158) into each of the mixing channels at a first location (e.g., 98) and, optionally, injecting a third fluid (e.g., 162) at a second location (e.g., 118) that is downstream of the first location. The second and third fluids can be any of the fluids described above (e.g., a scavenger), and can be the same or different. Injecting can be performed such that the second and/or third fluids flow along the inner surface of the reducer conduit. For example, each of the second and third fluids can be injected by communicating the fluid into a respective annular cavity (e.g., 90 or 110) defined around the reducer conduit and injecting the fluid from the annular cavity into the mixing channel via a plurality of passages (e.g., 94 or 114) defined through the reducer conduit. The second fluid can be injected into the mixing channel at a higher rate than the third fluid (e.g., if the injection area defined by the first passages (e.g., 94) is greater than that defined by the second passages (e.g., 114)).

Injecting can be performed such that the first, second, and third (if present) fluids flow into an expanding channel (e.g., 82) defined by an expander conduit (e.g., 70) (e.g., via the reducer outlet and an expander inlet (e.g., 74) of the expander conduit that is coupled to the reducer outlet), where the fluids mix to form a fluid mixture. The present methods can be performed such that the first, second, and/or third fluids mix turbulently, e.g., such that the second and/or third fluids break off from the inner surface of the reducer conduit at the reducer outlet (e.g., at a sharp edge (e.g., 76)) to form filaments which break up into droplets and mix with the first fluid.

Some methods comprise a step of decelerating each of the fluid mixtures (e.g., in a respective one of the expanding channels). For example, each of the expander conduits can converge from its expander inlet to its expander outlet (e.g., 78) such that the cross-sectional area of the expanding channel increases between the expander inlet and the expander outlet. Decelerating thus can comprise, for each of the fluid mixtures, communicating the fluid mixture through the expanding channel such that the fluid mixture decelerates.

Some methods comprise combining each of the fluid mixtures in an outlet channel defined by a second conduit. Optionally, the combining includes decelerating the fluid mixtures (e.g., if the cross-sectional area of the outlet channel decreases in a downstream direction, as described above).

Some methods comprise, for at least one of the mixing channels, moving a shut-off valve (e.g., 126) from an open position to a closed position such that fluid does not flow from the mixing channel to the outlet channel. As described above, moving the shut-off valve to the closed position can cause the flow rate of the first fluid in at least one other of the mixing channels to increase, and, in at least some circumstances, improve fluid mixing.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

For example, while mixing apparatus 10, as shown, comprises two mixers 50, other embodiments can comprise any suitable number of mixers, such as, for example, greater than or equal to or between any two of 2, 3, 4, 5, 6, 7, 8, 9, 10, or more mixers, each having any of the features described above with respect to mixer 50. By way of further example, while as shown first conduit 14 has multiple first outlets 30 and second conduit 18 has multiple second inlets 38—one first outlet and one second inlet for each of mixers 50—in some embodiments the first conduit and/or the second conduit can have a single first outlet or a single second inlet, respectively.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. An apparatus for mixing two or more fluids, the apparatus comprising:
- a first conduit defining an inlet channel;
- a second conduit defining an outlet channel; and
- an injection assembly that is disposed between the first and second conduits and comprises two or more mixers, each having:
  - a reducer conduit that defines a mixing channel between a reducer inlet and a reducer outlet, wherein:
    - the reducer inlet is coupled to the first conduit; and
    - the reducer conduit converges such that a cross-sectional area of the mixing channel decreases from the reducer inlet to the reducer outlet;
  - an expander conduit that defines an expanding channel between an expander inlet and an expander outlet, wherein:
    - the expander inlet is coupled to the reducer outlet and the expander outlet is coupled to the second conduit; and
    - the expander conduit diverges such that a cross-sectional area of the expanding channel increases from the expander inlet to the expander outlet; and
  - a first injection conduit configured to receive fluid and inject the fluid into the mixing channel, wherein:
    - the first injection conduit comprises a first annular cavity that is defined around the reducer conduit and is in fluid communication with the mixing channel via a plurality of first passages defined through the reducer conduit.

2. The apparatus of claim 1, wherein at least one of the mixers comprises a shut-off valve that is movable between an open position and a closed position in which the shut-off valve prevents fluid from flowing from the at least one mixer to the second conduit.

3. The apparatus of claim 1, wherein for each of the mixers:
- the first injection conduit is configured to inject fluid into the mixing channel at a first location; and
- the mixer comprises a second injection conduit configured to receive fluid and inject the fluid into the mixing channel at a second location that is closer to the reducer outlet than is the first location.

4. The apparatus of claim 1, wherein the injection assembly comprises, for each of the mixers, a first draining conduit configured to permit fluid communication between the first annular cavity and a draining nozzle.

5. The apparatus of claim 3, wherein for each of the mixers:
- the second injection conduit comprises a second annular cavity that is defined around the reducer conduit and is in fluid communication with the mixing channel via a plurality of second passages defined through the reducer conduit; and the first passages collectively define a first injection area and the second passages collectively define a second injection area that is smaller than the first injection area.

6. The apparatus of claim 1, wherein the first conduit:

has a first inlet and two or more first outlets, wherein each of the first outlets is coupled to a respective one of the reducer inlets and a cross-sectional area of the mixing channel at each first outlet is within 10% of the cross-sectional area of the mixing channel at the respective reducer inlet; and converges such that a cross-sectional area of the inlet channel decreases from the first inlet to the first outlets.

7. The apparatus of claim 6, wherein the second conduit:

has two or more second inlets and a second outlet, wherein each of the second inlets is coupled to a respective one of the expander outlets and a cross-sectional area of the outlet channel at each second inlet is within 10% of the cross-sectional area of the expanding channel at the respective expander outlet; and diverges such that a cross-sectional area of the outlet channel increases from the second inlets to the second outlet.

8. The apparatus of claim 7, wherein the first conduit, the second conduit, and the injection assembly are disposed within a pipe.

9. The apparatus of claim 1, wherein, for each of the mixers, a cross-sectional area of the mixing channel at the reducer outlet is at least 10% smaller than a cross-sectional area of the expanding channel at the expander inlet.

10. A method of mixing two or more fluids using the apparatus of claim 1, the method comprising:

communicating a first fluid through the inlet channel defined by the first conduit and into the mixing channels, each defined by a respective reducer conduit of the reducer conduits;

accelerating the first fluid in each of the mixing channels;

injecting a second fluid into each of the mixing channels such that the first and second fluids:

flow into a respective expanding channel of the expanding channels, the respective expanding channel defined by a respective expander conduit of the expander conduits; and mix to form a fluid mixture;

for each of the expanding channels, decelerating the fluid mixture; and combining the fluid mixtures in the outlet channel defined by the second conduit.

11. The method of claim 10, wherein each of the reducer conduits:

converges from the reducer inlet to the reducer outlet such that the first fluid accelerates when communicated through the mixing channel.

12. The method of claim 11, wherein each of the expander conduits:

diverges from the expander inlet to the expander outlet such that the fluid mixture decelerates when communicated through the expanding channel.

13. The method of claim 10, comprising, for at least one mixing channel of the mixing channels, moving a shut-off valve from an open position to a closed position such that fluid does not flow from the at least one mixing channel to the outlet channel and a flow rate of the first fluid in at least one other mixing channel of the mixing channels increases.

14. The method of claim 10, wherein:

the injecting comprises injecting the second fluid at a first location; and the method comprises, for each of the mixing channels, injecting a third fluid at a second location that is closer to the expanding channel than is the first location such that:

the first, second, and third fluids mix in the expanding channel; and the fluid mixture comprises the third fluid.

15. The method of claim 14, wherein, for each of the mixing channels, injecting the second fluid comprises:

communicating the second fluid to the first annular cavity disposed around the reducer conduit; and transferring the second fluid from the first annular cavity to the mixing channel via the plurality of first passages.

16. The method of claim 15, wherein, for each of the mixing channels, injecting the third fluid comprises:

communicating the third fluid to a second annular cavity disposed around the reducer conduit; and transferring the third fluid from the second annular cavity to the mixing channel via a plurality of second passages;

wherein the first passages collectively define a first injection area and the second passages collectively define a second injection area that is smaller than the first injection area.

17. The method of claim 10, wherein:

communicating the first fluid through the inlet channel comprises accelerating the first fluid through the inlet channel; and combining the fluid mixtures comprises decelerating the fluid mixtures in the outlet channel.

18. The method of claim 10, wherein, for each of the mixing channels, injecting the second fluid is performed such that the second fluid flows along an inner surface of the reducer conduit.

19. The method of claim 10, wherein the inlet channel, the mixing channels, the expanding channels, and the outlet channel are disposed within a pipe.

* * * * *